US007240642B2

(12) United States Patent
Chou

(10) Patent No.: US 7,240,642 B2
(45) Date of Patent: Jul. 10, 2007

(54) AIR COMPRESSOR HAVING CHANGEABLE STRUCTURE

(76) Inventor: Wen San Chou, No. 1-25, Kang Wei Village, An Din Hsiang, Tainan Hsien 74562 (TW)

( * ) Notice: Subject to any disclaimer, the term of this patent is extended or adjusted under 35 U.S.C. 154(b) by 36 days.

(21) Appl. No.: 11/204,524

(22) Filed: Aug. 16, 2005

(65) Prior Publication Data

US 2007/0065311 A1 Mar. 22, 2007

(51) Int. Cl.
*F01P 1/04* (2006.01)

(52) U.S. Cl. ..... 123/41.35; 417/63

(58) Field of Classification Search ..... 123/41.35; 417/415, 63

See application file for complete search history.

(56) References Cited

U.S. PATENT DOCUMENTS 6,135,725 A * 10/2000 Chou ..... 417/360
6,648,612 B2 * 11/2003 Hsiao ..... 417/313
6,783,333 B2 * 8/2004 Wang ..... 417/307
6,846,162 B2 1/2005 Chou

* cited by examiner

*Primary Examiner*—Stephen K. Cronin
*Assistant Examiner*—Hyder Ali
(74) *Attorney, Agent, or Firm*—Charles E. Baxley

(57) ABSTRACT

An air compressor includes a piston slidably received in a cylinder housing, and a motor coupled to the piston for moving the piston relative to the cylinder housing in a reciprocating action, in order to generate pressurized air. A cover is detachably secured on top of the cylinder housing, and includes an outlet tube having a compartment communicating with the cylinder housing, for receiving pressurized air from the cylinder housing, and includes an inlet blocked by a check valve device. The cover may be adjusted and secured to the cylinder housing, to adjust the inlet to different position relative to the cylinder housing, and to prevent the inlet from being blocked by objects.

1 Claim, 12 Drawing Sheets

AIR COMPRESSOR HAVING CHANGEABLE STRUCTURE

BACKGROUND OF THE INVENTION

1. Field of the Invention

The present invention relates to an air compressor, and more particularly to an air compressor having a detachable or changeable structure for allowing an outlet tube of the air compressor to be adjusted to different angular positions or directions, and for allowing the air compressor to be attached to or received within various receptacles.

2. Description of the Prior Art

Typical air compressors comprise a cylinder housing attached or secured to a base and having a piston slidably disposed therein, and a motor secured to the base and coupled to the piston of the cylinder housing for actuating or driving the piston of the cylinder housing in a reciprocating action.

The applicant has developed various kinds of typical air compressors, such as U.S. Pat. No. 6,846,162 to Chou, which also comprises a piston slidably disposed within a cylinder housing and slidable along or relative to the cylinder housing in a reciprocating action and in a great speed, and an outlet tube extended from and formed integral with the cylinder housing and having one or more ducts extended outwardly from the outlet tube for receiving the pressurized air from the outlet tube.

The ducts may be coupled to various kinds of facilities that require pressurized air supplied thereto, such as pressure gauges, air nozzles, safety valves, relief valves, etc. However, the outlet tube and the ducts are formed integral with the cylinder housing, such that the outlet tube and the ducts may include a large volume altogether, and may not be adjusted to different directions or positions relative to the cylinder housing, such that the cylinder housing and the outlet tube and the ducts may not be suitably engaged into or received within some of the outer receptacles or packages, or the like.

The present invention has arisen to mitigate and/or obviate the afore-described disadvantages of the conventional air compressors.

SUMMARY OF THE INVENTION

The primary objective of the present invention is to provide an air compressor including a detachable or changeable structure for allowing an outlet tube of the air compressor to be adjusted to different angular positions or directions, and for allowing the air compressor to be attached to or received within various receptacles.

In accordance with one aspect of the invention, there is provided an air compressor comprising a cylinder housing including a chamber formed therein, and defined by a peripheral wall, a piston slidably received in the chamber of the cylinder housing, and having a piston rod extended therefrom, a motor coupled to the piston rod, for moving the piston relative to the cylinder housing in a reciprocating action, in order to generate pressurized air, and a cover detachably secured on top of the cylinder housing, for enclosing and blocking the chamber of the cylinder housing, and including an outlet tube having a compartment formed therein and communicating with the chamber of the cylinder housing, for receiving pressurized air from the chamber of the cylinder housing.

The cylinder housing includes at least two studs provided on an outer peripheral portion thereof, and the cover includes at least two ears formed therein and selectively aligned with the at least two studs of the cylinder housing, for receiving fasteners which adjustably secure the cover on top of the cylinder housing.

The cover includes a check valve to control the inner air of the chamber of the cylinder housing to flow into the compartment of the outlet tube when the piston moves toward the cover, and to prevent the air from flowing out of the compartment of the outlet tube when the piston moves away from the cover.

The outlet tube includes a valve seat provided therein, and the check valve is disposed in the outlet tube and engaged with the valve seat, to control the pressurized air to flow from the chamber of the cylinder housing into the compartment of the outlet tube, and to prevent the pressurized air from flowing backwardly from the compartment of the outlet tube into the chamber of the cylinder housing.

The cover includes a valve device to control the outside air to flow into the chamber of the cylinder housing when the piston moves away from the cover, and to prevent the air from flowing out of the chamber of the cylinder housing through the valve device when the piston moves toward the cover.

The cover includes an inlet formed therein, and the valve device is secured to the cover, for blocking the inlet of the cover, and for controlling the outside air to flow into the chamber of the cylinder housing. The cover includes a recess formed therein and communicating with the inlet thereof, for receiving the valve device. The cover includes a catch extended therefrom, the valve device includes a first end secured to the catch of the cover.

The cover includes a peripheral slot formed therein, for receiving a sealing ring and for partially receiving the peripheral wall of the cylinder housing, and for making an air tight seal between the cover and the cylinder housing.

A supporting base may further be provided and includes a plate having an arm extended therefrom to support the cylinder housing, the motor being attached to the plate and including a spindle extended through the plate, and an eccentric member coupled to the spindle of the motor and having a pin extended therefrom and coupled to the piston rod, to move the piston relative to the cylinder housing with the motor the eccentric member.

The plate includes a gear rotatably attached thereto and rotatably attached to the plate with a shaft, the eccentric member is secured to the shaft and has the pin extended therefrom.

The cover includes a first duct, and a second duct extended outwardly from the outlet tube and communicating with the compartment of the outlet tube, for receiving the pressurized air from the compartment of the outlet tube, a pressure gauge attached to the first duct, a nozzle coupled to the second duct, and a valve attached to the duct.

The cylinder housing includes an open top, and the cover is detachably secured on top of the cylinder housing for enclosing and blocking the chamber of the cylinder housing.

The cylinder housing includes an upper wall provided thereon for enclosing an upper portion of the chamber thereof, the upper wall includes a center opening formed therein and defined by a peripheral fence, and the cover is secured on top of the cylinder housing and includes a check valve engaged into the compartment of the outlet tube and biased to engage with the peripheral fence, for controlling the inner air to flow from the chamber of the cylinder housing into the compartment of the outlet tube.

The upper wall includes an inlet formed therein, and a valve device secured to the upper wall, for blocking the inlet of the upper wall, and for controlling the outside air to flow into the chamber of the cylinder housing.

The piston includes a bore formed therein, and a valve device secured to the piston, for blocking the bore of the piston, and for controlling the outside air to flow into the chamber of the cylinder housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 7:
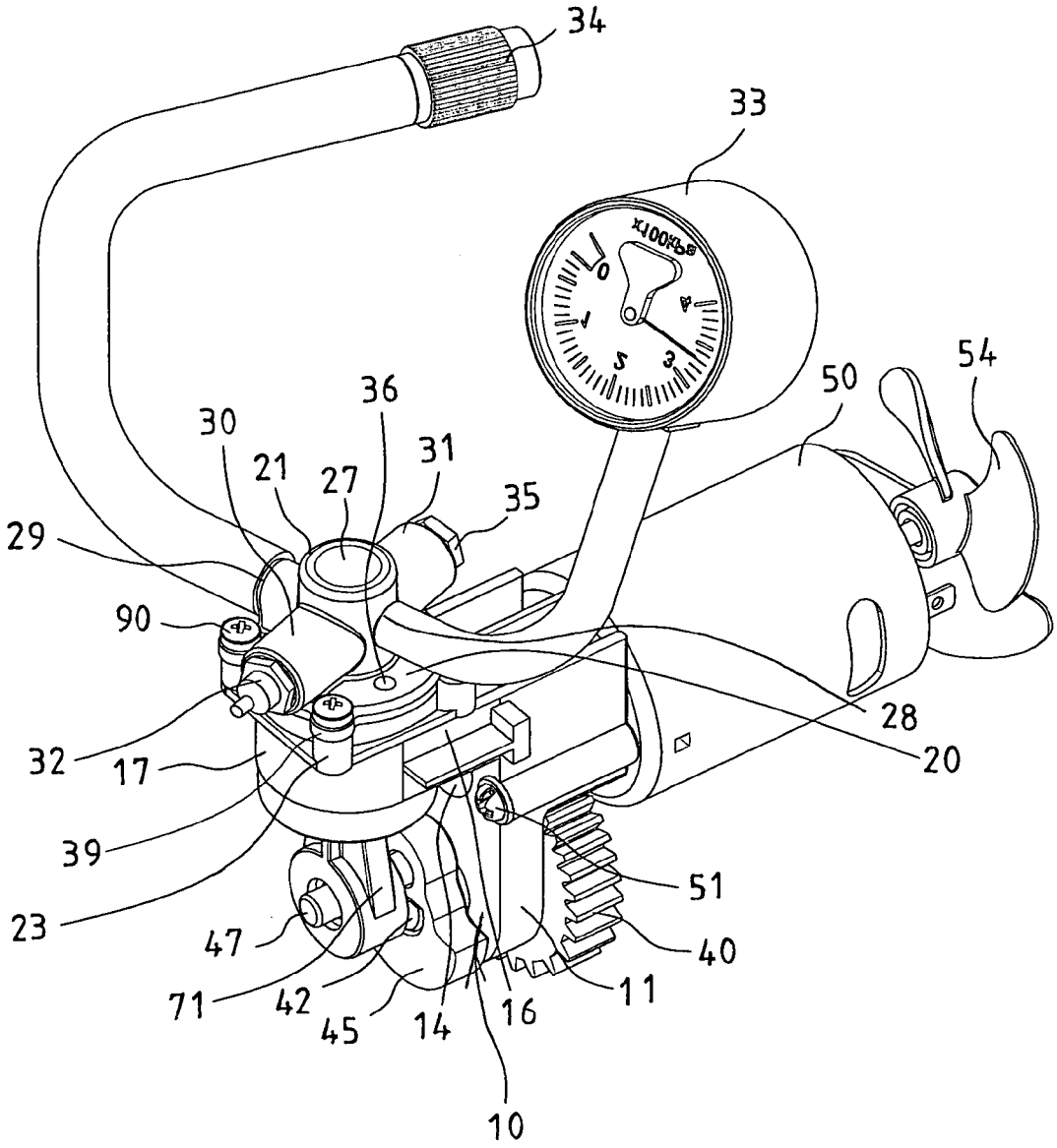
FIG. 7 is a perspective view similar to FIG. 1, illustrating the operation of the air compressor.
Figure 8:
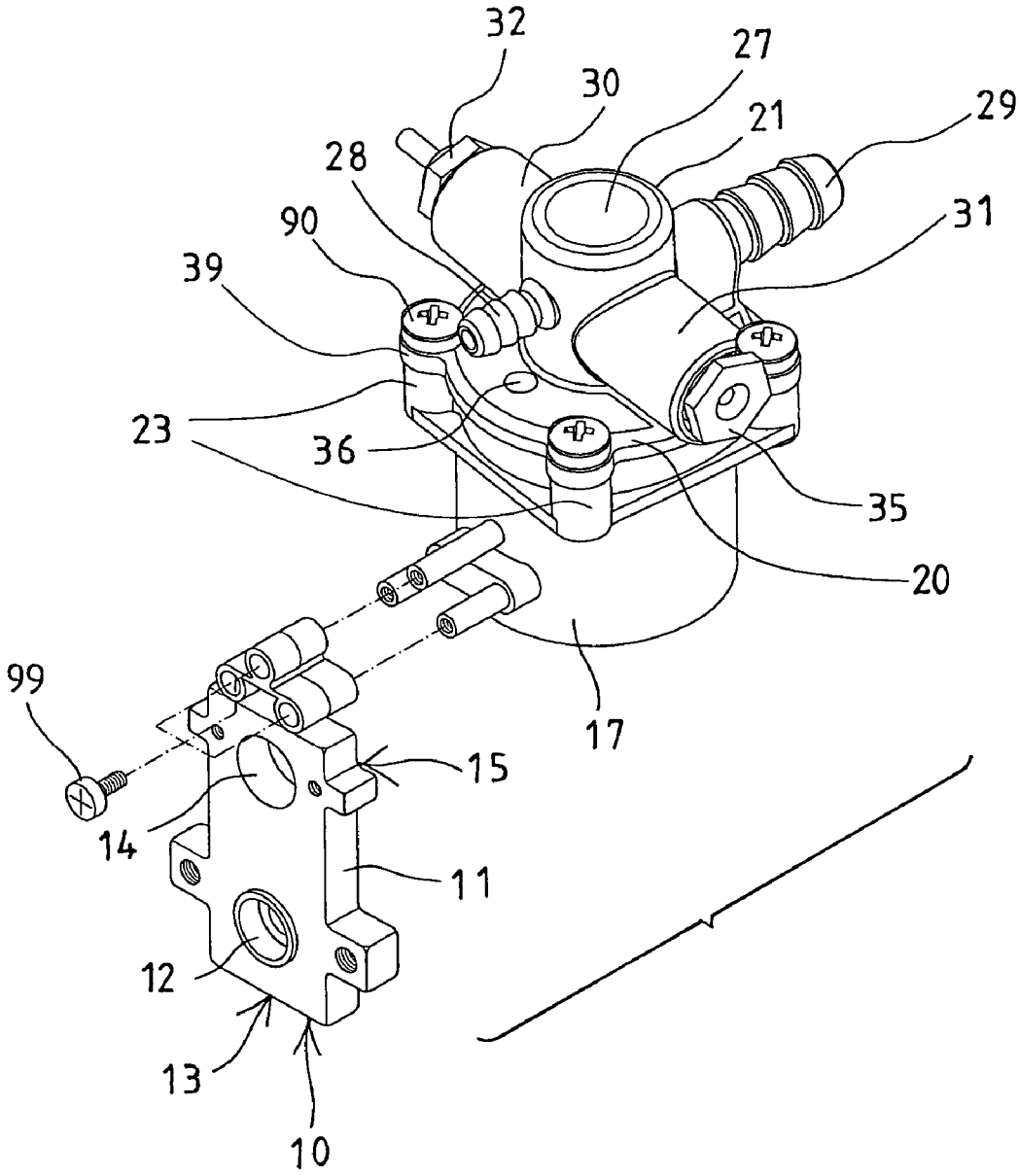
FIG. 8 is a further partial exploded view of the air compressor.

Referring to the drawings, and initially to FIGS. 1–8, an air compressor in accordance with the present invention comprises a supporting base 10 including a plate 11 having an aperture 12 formed in a lower portion 13 thereof, and having an orifice 14 formed in an upper portion 15 thereof (FIGS. 5, 8), and having an arm 16 laterally extended from the upper portion 15 thereof, and a cylinder housing 17 provided on or extended from the arm 16 and preferably formed integral with the arm 16 and the plate 11, but the cylinder housing 17 may also be separated from the plate 11 and detachably secured to the plate 11 with such as fasteners 99 (FIG. 8).

The cylinder housing 17 includes a chamber 18 formed therein (FIGS. 2–4) and having an open top (FIG. 2) and an open bottom (FIGS. 3, 4), and defined by a peripheral wall 19 (FIGS. 2), for slidably receiving a piston 70 therein. The piston 70 is slidably received in the chamber 18 of the cylinder housing 17, and includes an extension or piston rod 71 extended therefrom, for allowing the piston 70 to slide in reciprocating action in the chamber 18 of the cylinder housing 17, and to generate pressurized air. The piston 70 includes a sealing ring 72 attached or secured onto the outer peripheral portion thereof and slidably engaged with the cylinder housing 17, for making an air tight seal between the piston 70 and the cylinder housing 17.

The cylinder housing 17 includes a cover 20 detachably secured on top thereof with such as fasteners 90, for enclosing or blocking the open top of the chamber 18 thereof (FIGS. 2–4), and a sealing ring 91 is disposed and engaged between the cover 20 and the cylinder housing 17, for making an air tight seal between the cover 20 and the cylinder housing 17. For example, the cover 20 includes a peripheral slot 92 formed in the bottom portion thereof (FIG. 6), for receiving the sealing ring 91 and for partially receiving the peripheral wall 19 of the cylinder housing 17. The cover 20 includes an outlet tube 21 extended upwardly or outwardly from the top thereof, and having a compartment 22 formed therein and communicating with the chamber 18 of the cylinder housing 17, for receiving the pressurized air from the chamber 18 of the cylinder housing 17.

A spring-biased check valve 24 (FIGS. 2–4) may be disposed in the outlet tube 21, and engaged with a valve seat 26 that is formed or provided between the outlet tube 21 and the cylinder housing 17, for controlling the inner air to flow from the chamber 18 of the cylinder housing 17 into the compartment 22 of the outlet tube 21 only, and for preventing the inner air from flowing backwardly from the compartment 22 of the outlet tube 21 into the chamber 18 of the cylinder housing 17 through the check valve 24. A cap 27 may be attached to the outer or free end of the outlet tube 21 with such as threading engagements, for blocking or enclosing the compartment 22 of the outlet tube 21, and for stably retaining the spring-biased check valve 24 within the compartment 22 of the outlet tube 21.

A relief valve or safety valve (not shown) may further be provided and attached to the outlet tube 21 when the cap 27 is disengaged from the outer or free end of the outlet tube 21, for relieving the pressurized air when the air pressure within the cylinder housing 17 and the outlet tube 21 is overpressurized, or when the air pressure reaches a predetermined value. The spring-biased check valve 24 may thus be used to control the pressurized air to flow from the chamber 18 of the cylinder housing 17 into the compartment 22 of the outlet tube 21, and to prevent the pressurized air from flowing backwardly from the compartment 22 of the outlet tube 21 into the chamber 18 of the cylinder housing 17.

The cylinder housing 17 or the cover 20 further includes one or more ducts 28, 29, 30, 31 extended outwardly from the outlet tube 21, and communicating with the compartment 22 of the outlet tube 21, for receiving the pressurized air from the compartment 22 of the outlet tube 21. The ducts 28, 29, 30, 31 may be coupled to various kinds of facilities that require pressurized air supplied thereto. One or more lids (not shown) may further be provided and attached or secured to either of the ducts 28, 29, 30, 31 with such as threading engagements, for selectively enclosing or blocking the ducts 28, 29, 30, 31, when the ducts 28, 29, 30, 31 are not required to be used.

For example, a pressure gauge 33 may be provided and attached to one of the ducts 28, for detecting and showing the air pressure within the cylinder housing 17 and/or the outlet tube 21. A nozzle 34 may be provided and attached to another duct 29, for allowing the pressurized air to be supplied from the chamber 18 of the cylinder housing 17 and the compartment 22 of the outlet tube 21 to various facilities that require pressurized air supplied thereto, with the nozzle 34.

A safety valve 32 may further be provided and attached to the other duct 30, for relieving the pressurized air when the air pressure within the cylinder housing 17 and/or the outlet tube 21 reaches a predetermined pressure or the highest pressure, and thus for preventing the cylinder housing 17 and/or the outlet tube 21 from being over-pressurized. A relief valve 35 may further be provided and attached to the further duct 31, for relieving the pressurized air when the air pressure within the cylinder housing 17 and/or the outlet tube 21 is over-pressurized. It is to be noted that the provision or the extension of the ducts 28, 29, 30, 31 from the outlet tube 21 allows the pressure gauge 33 and the nozzle 34 and the safety valve 32 and the relief valve 35 to be easily and readily attached to or coupled to the outlet tube 21 with the ducts 28, 29, 30, 31, without additional or specialized coupling members or tools.

A gear 40 is rotatably attached to the lower portion 13 of the plate 11 with one or more bearings and a shaft 42, and an eccentric member 45 is secured to the shaft 42 of the gear 40 and rotated in concert with the gear 40 and includes a crank or an eccentric pin 47 extended therefrom and coupled to the piston rod 71 of the piston 70, in order to actuate or to move the piston 70 relative to the cylinder housing 17 in reciprocating actions.

A motor 50 may be attached or secured to the upper portion 15 of the plate 11 with such as fasteners 51 (FIGS. 1, 2, 7), and includes a spindle 52 extended into the upper orifice 14 of the plate 11 (FIGS. 3, 4), and includes a pinion 53 secured to the spindle 52 thereof, and engaged with the gear 40, for allowing the gear 40 to be rotated or driven by the motor 50 via the pinion 53, and thus for allowing the piston 70 to be actuated or moved relative to the cylinder housing 17 in reciprocating actions by the eccentric member 45 and the eccentric pin 47. A fan device 54 may further be provided and coupled to the motor 50 for being rotated or driven by the motor 50 to generate circulating or ventilating air.

Figure 3:
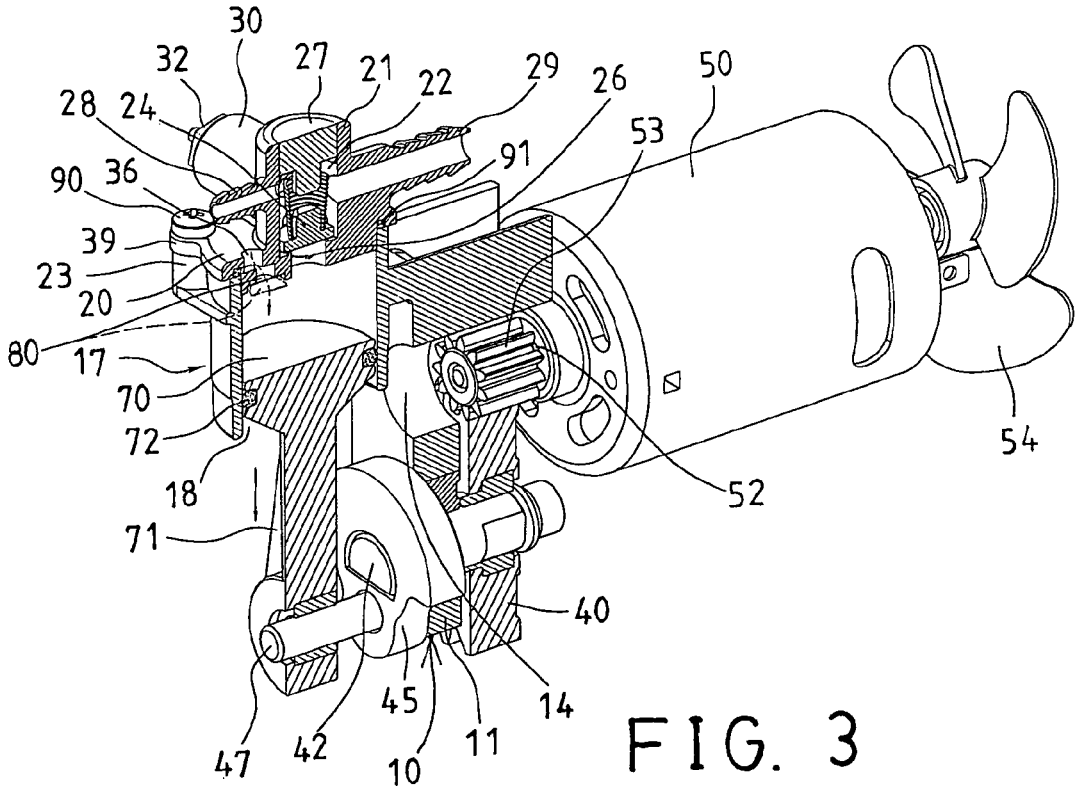
FIG. 3 is a perspective view similar to FIG. 1, in which one half of the air compressor is cut off for showing an inner structure of the air compressor.
Figure 4:
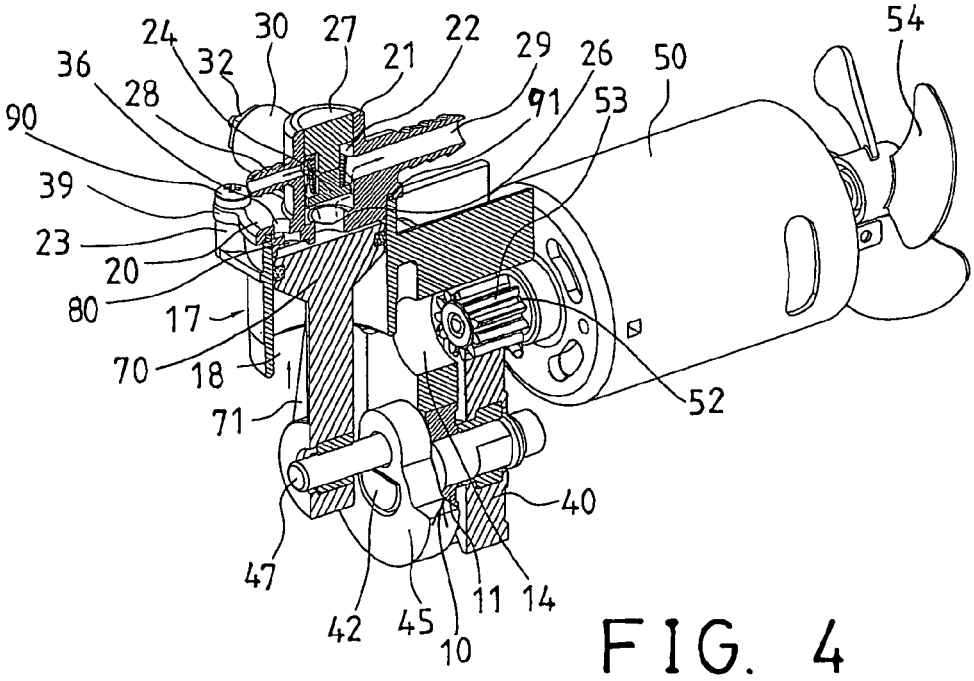
FIG. 4 is a perspective view similar to FIG. 3, illustrating the operation of the air compressor.
Figure 5:
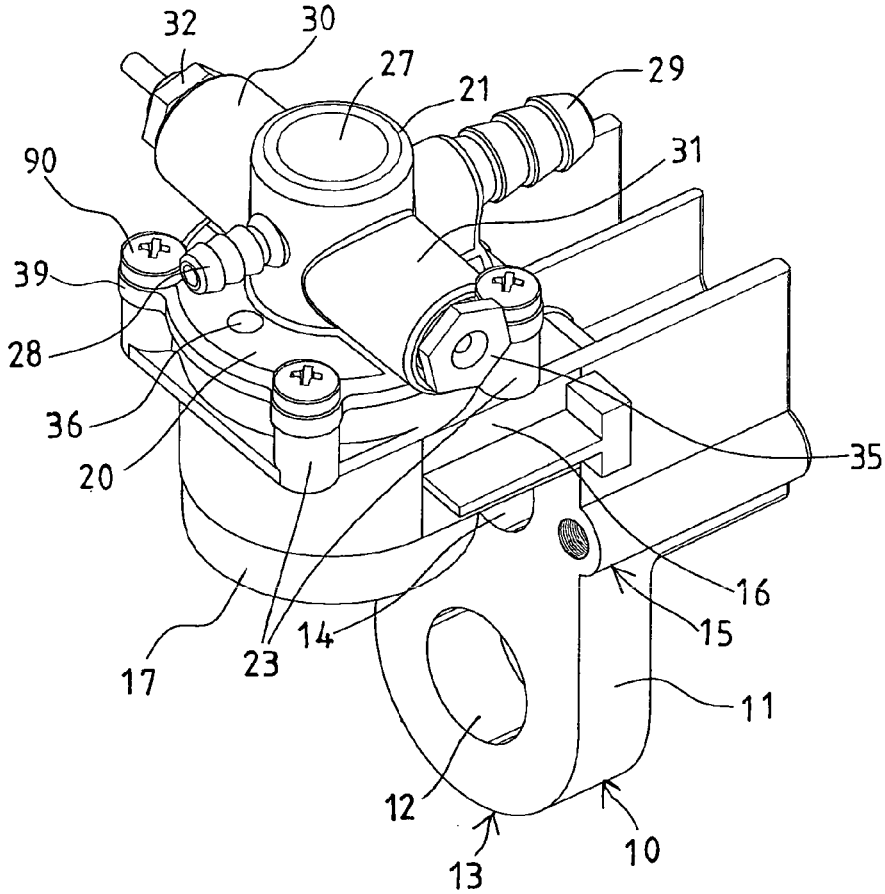
FIG. 5 is a partial perspective view of the air compressor, in which some of the parts or elements have been removed from the air compressor.
Figure 6:
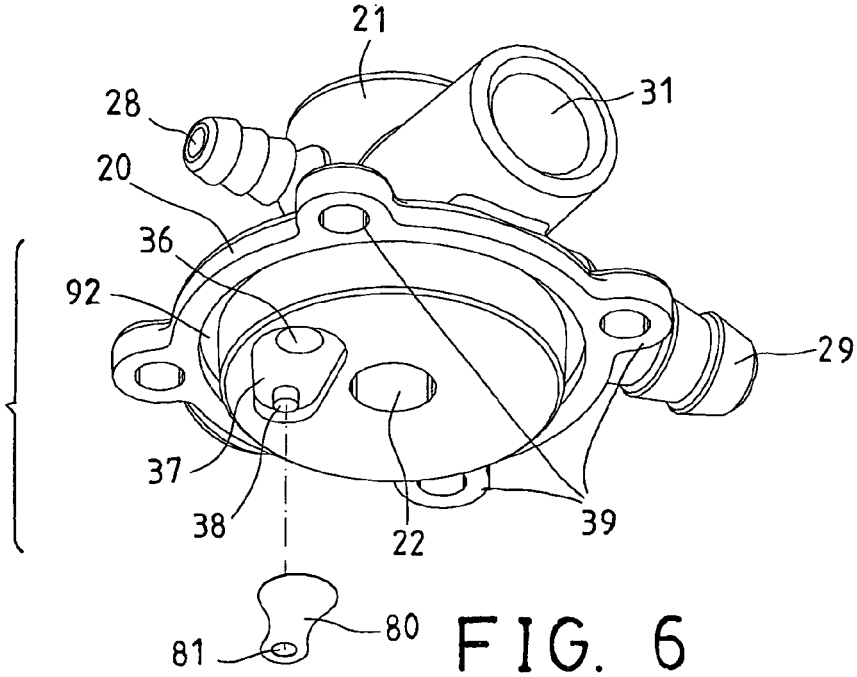
FIG. 6 is a partial exploded view as seen from the bottom of a cover of the air compressor.

In operation, as shown in FIGS. 3 and 4, the piston 70 may be actuated or moved relative to the cylinder housing 17 in reciprocating actions by the motor 50 via pinion 53, the gear 40, the eccentric member 45 and the eccentric pin 47, in order to generate a pressurized air, and to allow the pressurized air to flow into the outlet tube 21, and then to flow out through either or all of the ducts 28, 29, 30, 31, and thus to allow the air pressure within the cylinder housing 17 and/or the outlet tube 21 to be detected and shown by the pressure gauge 33, and to allow the pressurized air to be supplied into the facilities that require pressurized air supplied thereto, with the nozzle 34, and/or to the pressurized air to be relieved via the relief valve 32 or the safety valve 35 when the cylinder housing 17 and/or the outlet tube 21 is over-pressurized or reaches the predetermined pressure or the highest pressure.

As shown in FIGS. 2–4 and 6, the cover 20 further includes an inlet 36 formed therein and communicating with the chamber 18 of the cylinder housing 17, for allowing outside air to flow into the chamber 18 of the cylinder housing 17, and includes a recess 37 formed in the bottom portion thereof and communicating with the inlet 36 thereof, and includes a catch 38 extended therefrom or extended into the recess 37 thereof. A valve device 80 includes one or first end 81 engaged with or attached to the catch 38 of the cover 20, for attaching or securing the one or first end 81 of the valve device 80 to the cover 20.

The valve device 80 includes a spring blade structure or is a spring blade for biasing and blocking or enclosing the inlet 36 of the cover 20, and for forming or acting as a check valve means or device to control the outside air to flow into the chamber 18 of the cylinder housing 17 when the piston 70 moves away from the cover 20, and to prevent the inner air from flowing out of the chamber 18 of the cylinder housing 17 through the valve device 80 when the piston 70 moves toward the cover 20.

The cylinder housing 17 includes one or more, such as four studs 23 formed or provided on the outer peripheral portion thereof, and the cover 20 further includes one or more, such as four holes or ears 39 formed therein and selectively aligned with the studs 23 of the cylinder housing 17, for receiving the fasteners 90 which may secure the cover 20 on top of the cylinder housing 17.

Figure 1:
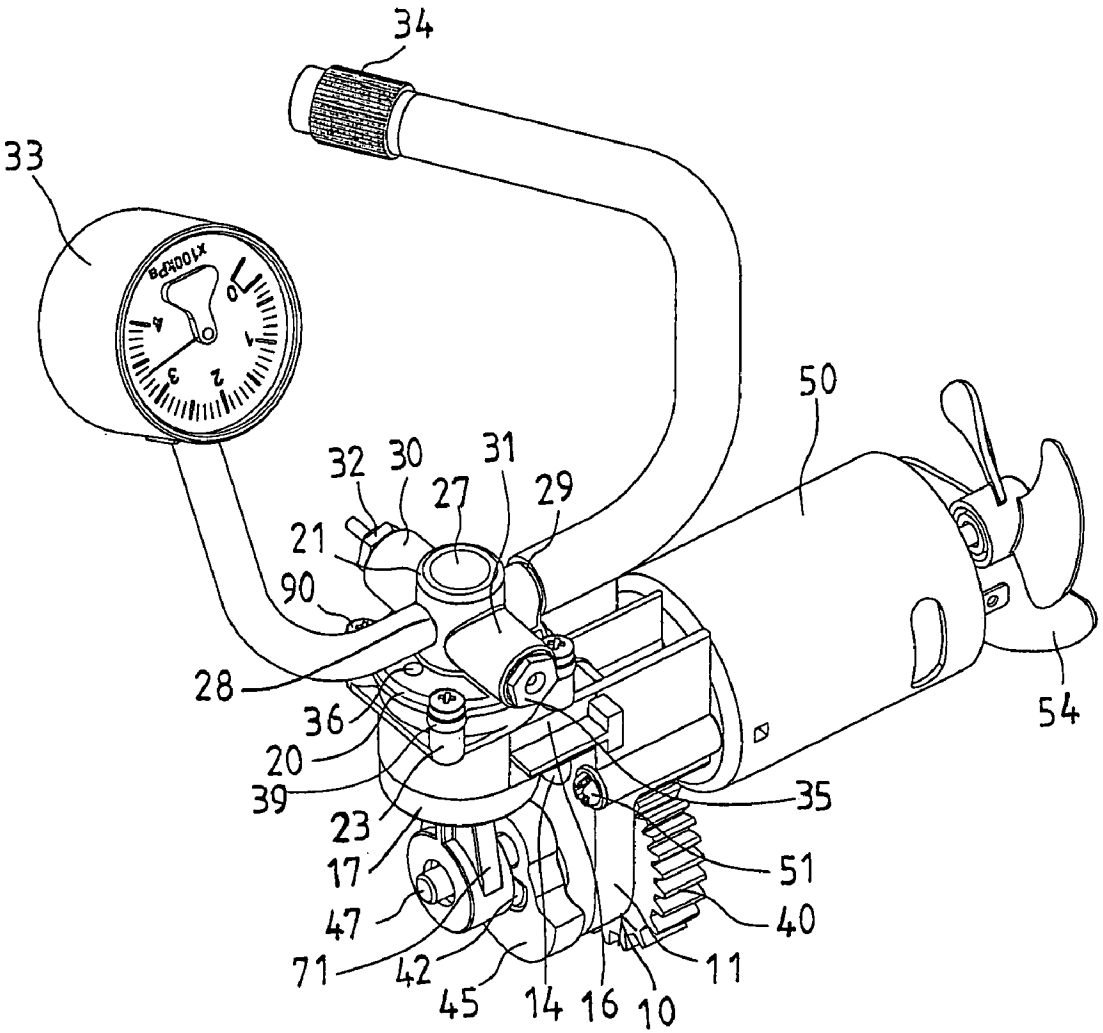
FIG. 1 is a perspective view of an air compressor in accordance with the present invention.
Figure 2:
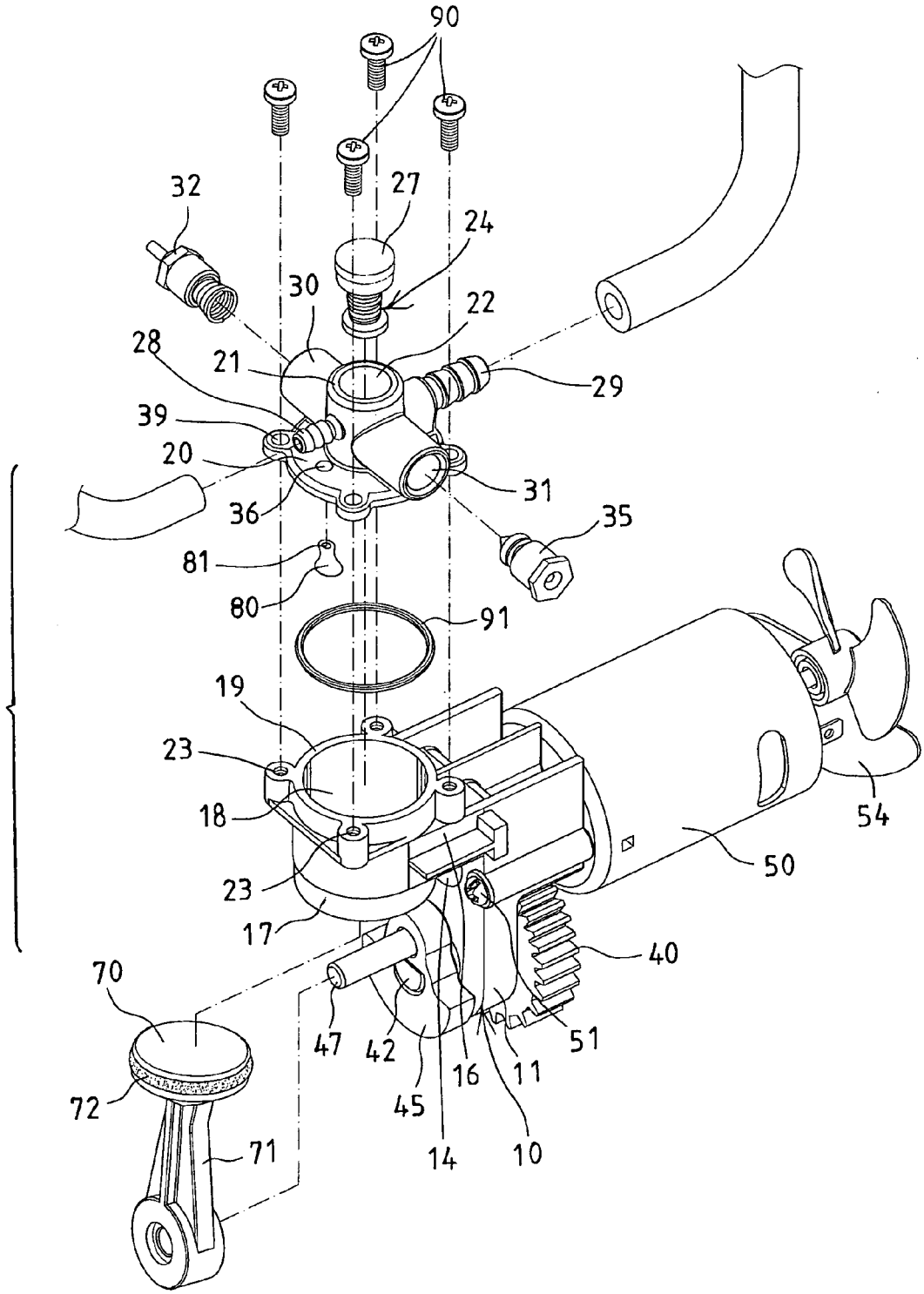
FIG. 2 is a partial exploded view of the air compressor.

It is to be noted that the cover 20 may be rotated or adjusted relative to the cylinder housing 17 to different angular position, before the fasteners 90 secure the cover 20 on top of the cylinder housing 17, and thus to allow the inlet 36 and the outlet tube 21 and the ducts 28, 29, 30, 31 of the cover 20 to be rotated or adjusted relative to the cylinder housing 17 to different angular position or location, for example, the status of different positions of the cover 20 relative to the cylinder housing 17 are shown in FIGS. 1 and 7, and thus for allowing the air compressor to be attached to or received within various receptacles or packages.

Figure 9:
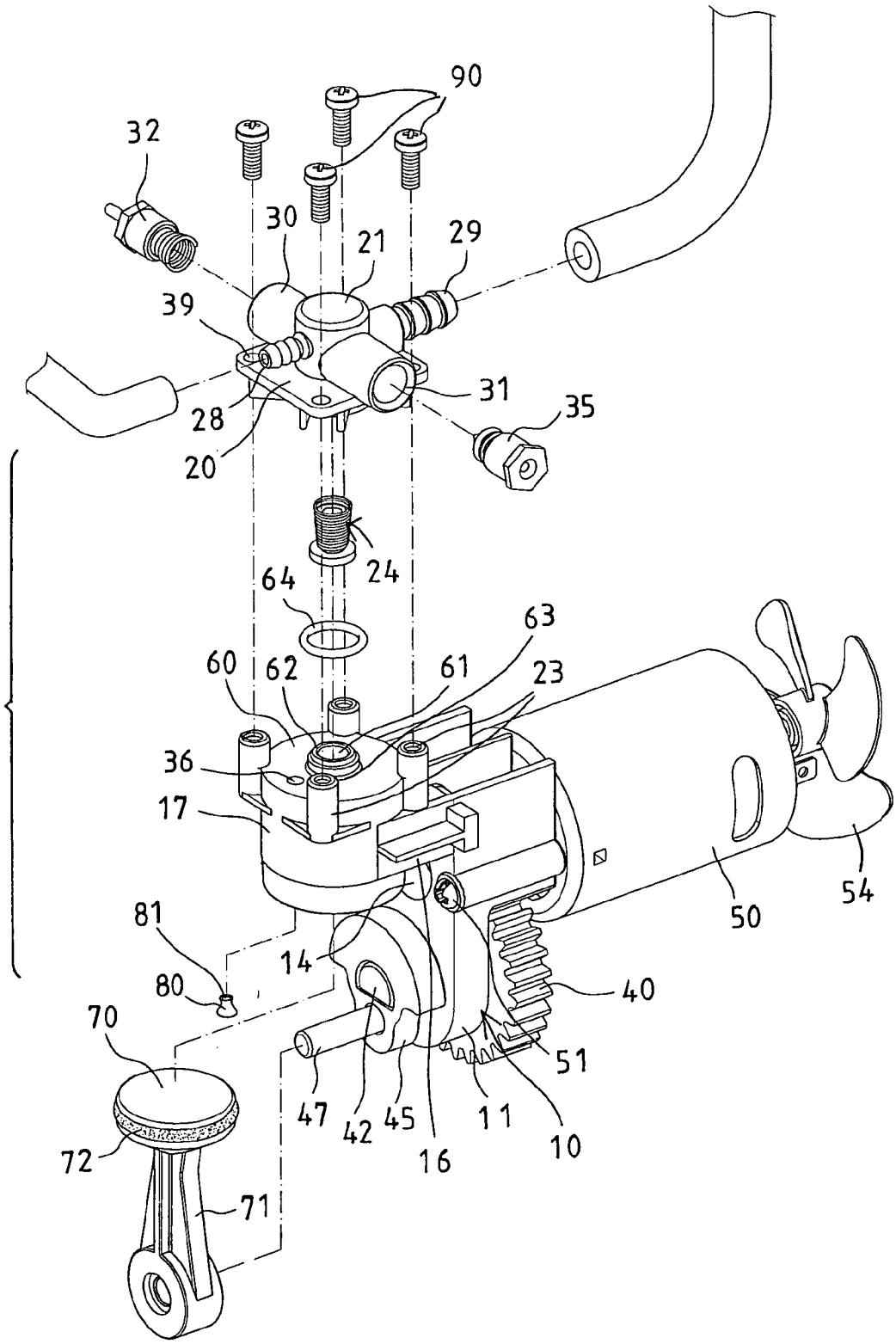
FIG. 9 is a partial exploded view similar to FIG. 2, illustrating the other arrangement of the air compressor.
Figure 10:
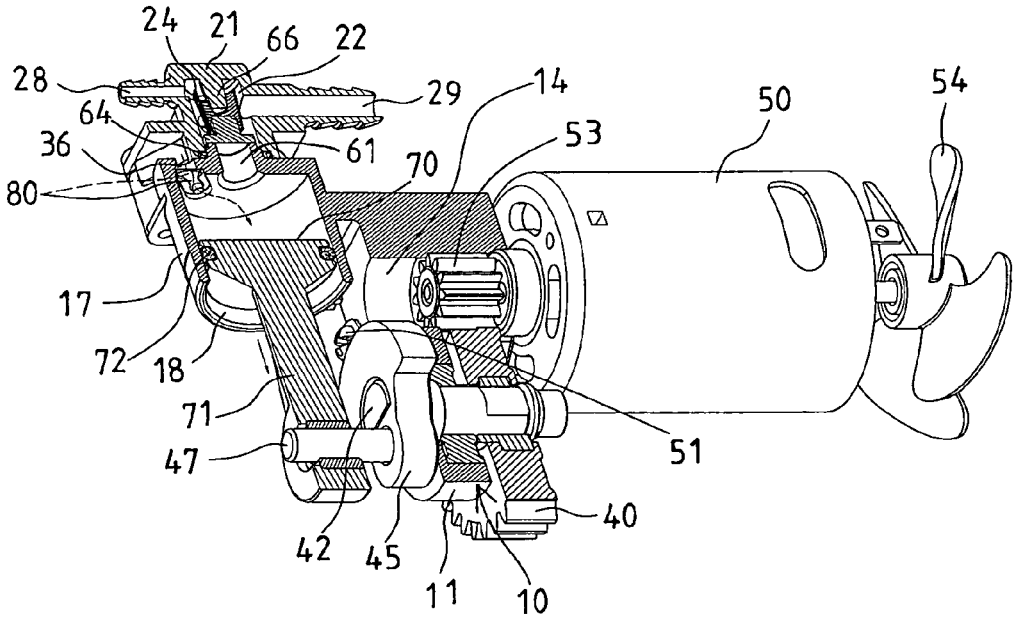
FIG. 10 is a perspective view of the air compressor as shown in FIG. 9, in which one half of the air compressor is cut off for showing an inner structure of the air compressor.
Figure 11:
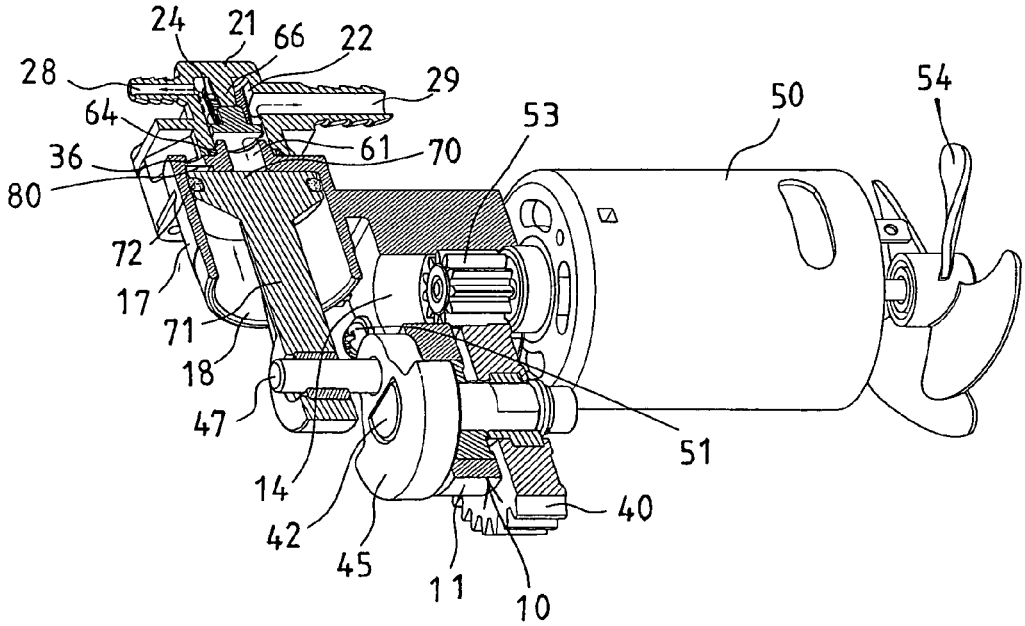
FIG. 11 is a perspective view similar to FIG. 10, illustrating the operation of the air compressor as shown in FIGS. 9–11.
Figure 12:
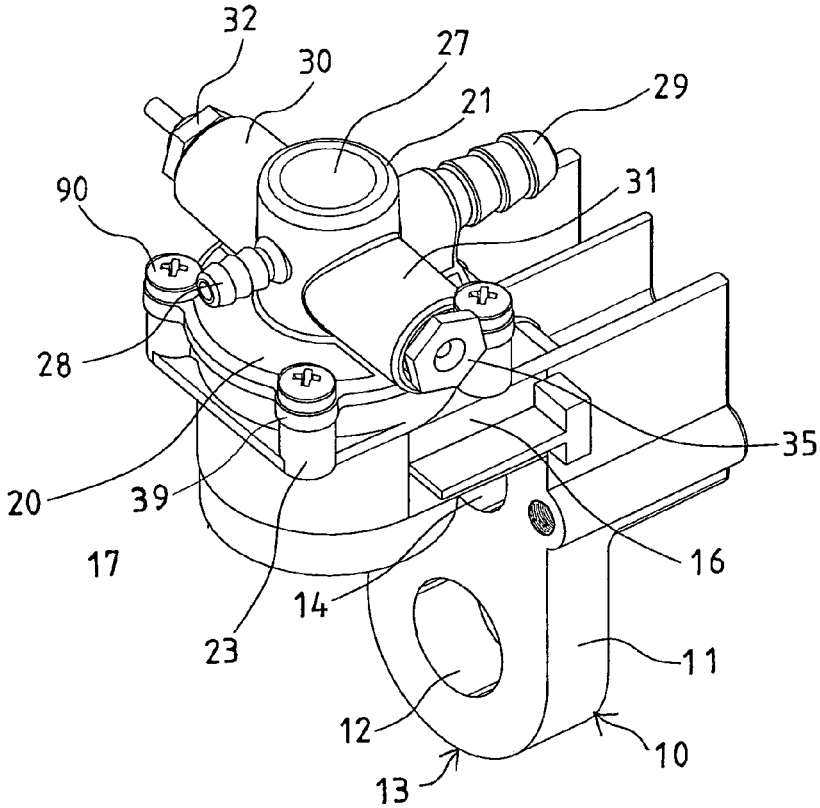
FIG. 12 is a perspective view illustrating another arrangement of the air compressor.
Figure 14:
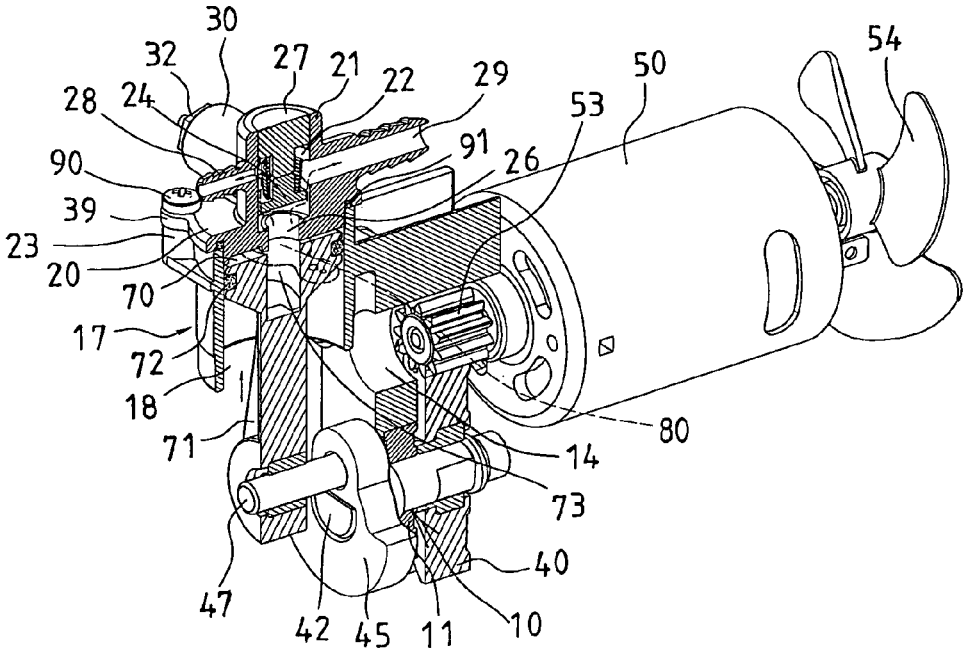
FIG. 14 is a perspective view of the air compressor as shown in FIGS. 12–13, in which one half of the air compressor is cut off for showing an inner structure of the air compressor.
Figure 13:
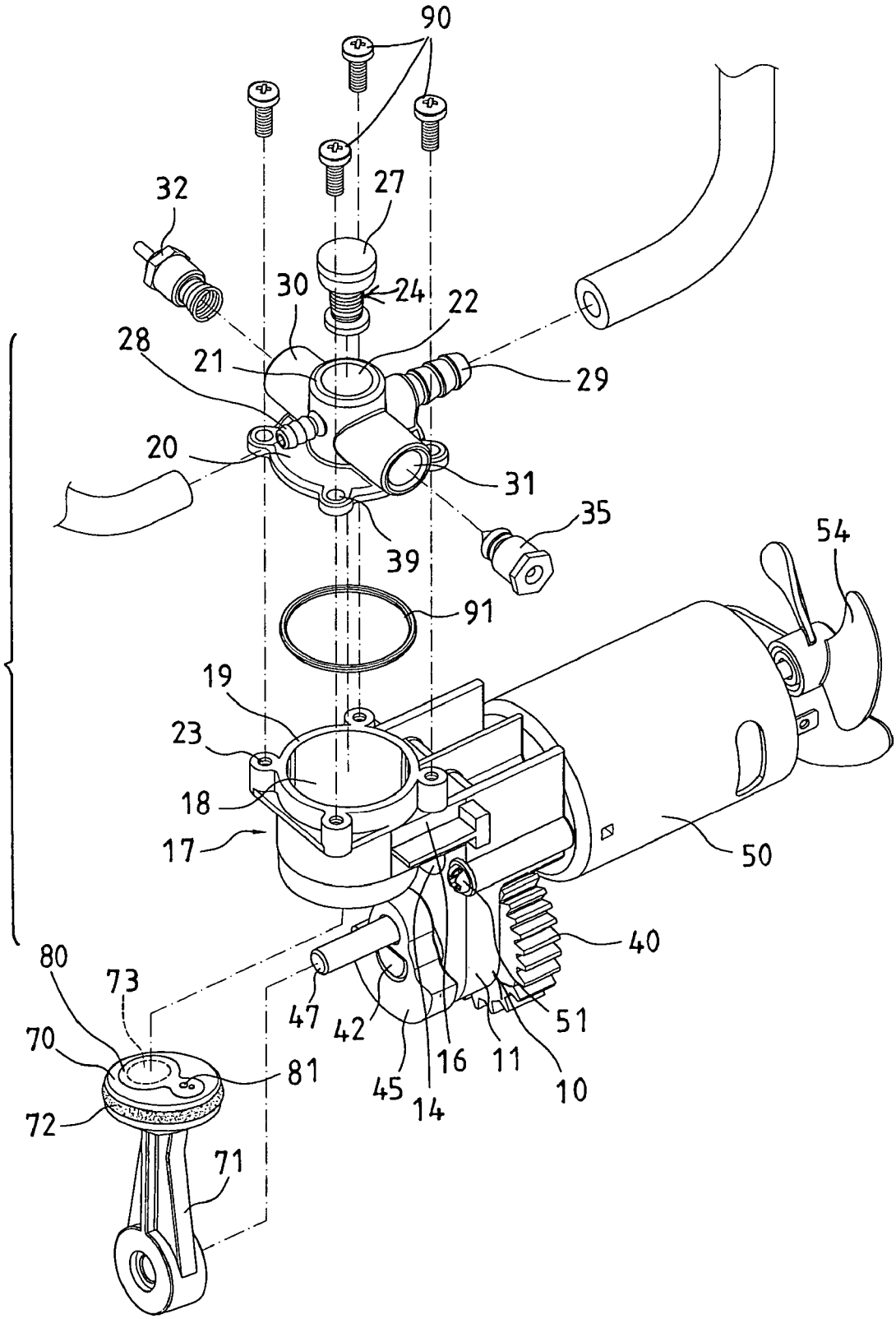
FIG. 13 is a partial exploded view of the air compressor as shown in FIG. 12.
Figure 15:
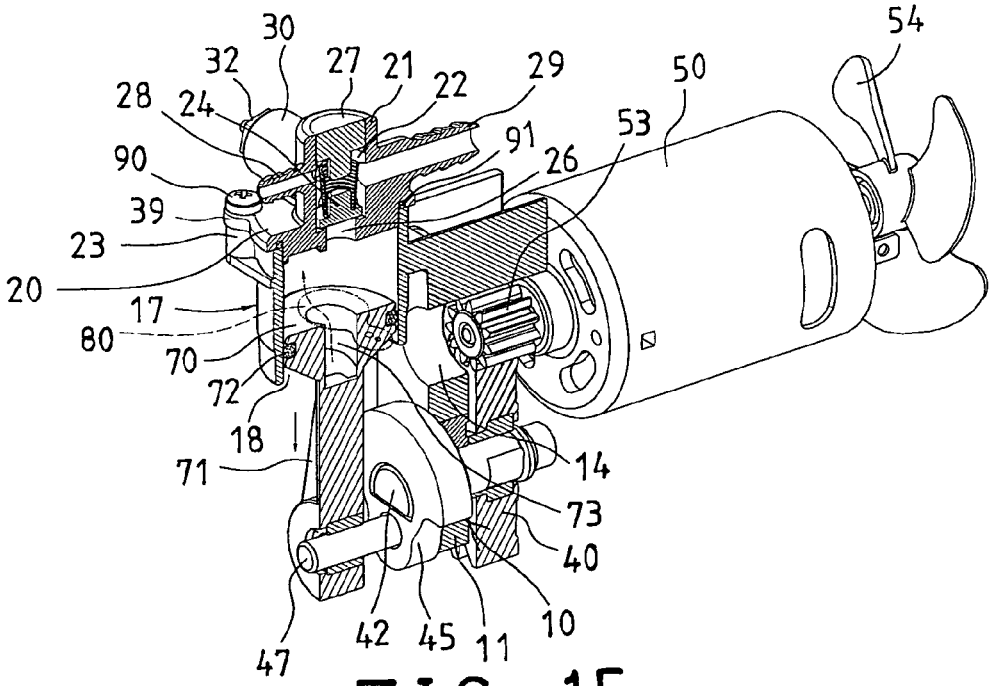
FIG. 15 is a perspective view similar to FIG. 14, illustrating the operation of the air compressor as shown in FIGS. 12–15.

Alternatively, as shown in FIGS. 9–11, the cylinder housing 17 includes an upper wall 60 provided thereon for enclosing the upper portion of the chamber 18 thereof, and includes the inlet 36 formed therein, and includes a center opening 61 formed therein and defined by a peripheral fence 62, and includes a peripheral groove 63 formed therein and located around the peripheral fence 62, for receiving a sealing ring 64.

The cover 20 may be secured on top of the cylinder housing 17, and the spring-biased check valve 24 may be engaged into the compartment 22 of the outlet tube 21 via the lower or bottom portion thereof, and biased to engage with the peripheral fence 62, for controlling the inner air to flow from the chamber 18 of the cylinder housing 17 into the compartment 22 of the outlet tube 21 when the piston 70 moves toward the cover 20, and for preventing the inner air from flowing backwardly from the compartment 22 of the outlet tube 21 into the chamber 18 of the cylinder housing 17 when the piston 70 moves away from the cover 20.

The compartment 22 of the outlet tube 21 is preferably a blind compartment 22, and the outlet tube 21 includes a peg 66 extended therefrom, or extended into the compartment 22 thereof, for engaging with the spring-biased check valve 24, and for stably anchoring or positioning the spring-biased check valve 24 within the compartment 22 of the outlet tube 21. The sealing ring 64 is engaged between the upper wall 60 of the cylinder housing 17 and the cover 20, for making an air tight seal between the cover 20 and the upper wall 60 of the cylinder housing 17.

It is also to be noted that the upper wall 60 of the cylinder housing 17 is spaced away from the cover 20, and the inlet 36 of the upper wall 60 of the cylinder housing 17 may thus be kept out of the other objects or receptacles or packages, such that the inlet 36 of the upper wall 60 of the cylinder housing 17 may be prevented from being blocked or shielded when the air compressor is attached to or received within various receptacles or packages. In addition, the outlet tube 21 and the ducts 28, 29, 30, 31 of the cover 20 may also be rotated or adjusted relative to the cylinder housing 17 to different angular position or location, for allowing the air compressor to be attached to or received within various receptacles or packages.

Further alternatively, as shown in FIGS. 12–15, the cover 20 of the cylinder housing 17 includes no inlet formed therein. Instead, the piston 70 includes a bore 73 formed therein, and the valve device 80 includes one or first end 81 engaged with or attached to the piston 70, for biasing and blocking or enclosing the bore 73 of the piston 70, and for forming a check valve means or device to control the outside air to intake or to flow into the chamber 18 of the cylinder housing 17 when the piston 70 moves away from the cover 20, and to prevent the inner air from flowing backwardly or outwardly from the chamber 18 of the cylinder housing 17 through the bore 73 of the piston 70 when the piston 70 moves toward the cover 20.

Figure 16:
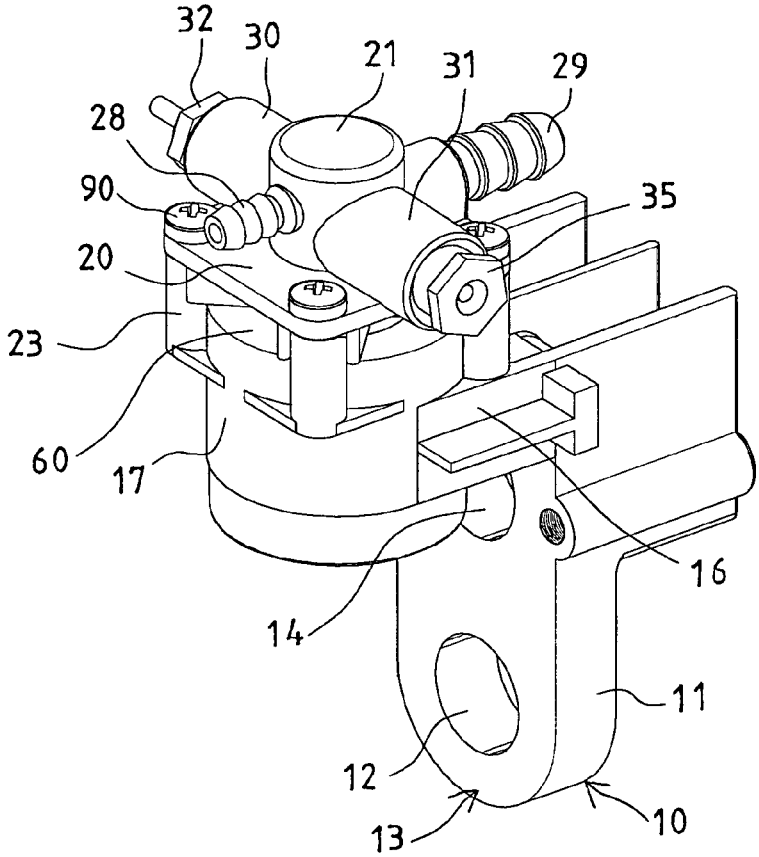
FIG. 16 is a perspective view similar to FIG. 12, illustrating the further arrangement of the air compressor.
Figure 17:
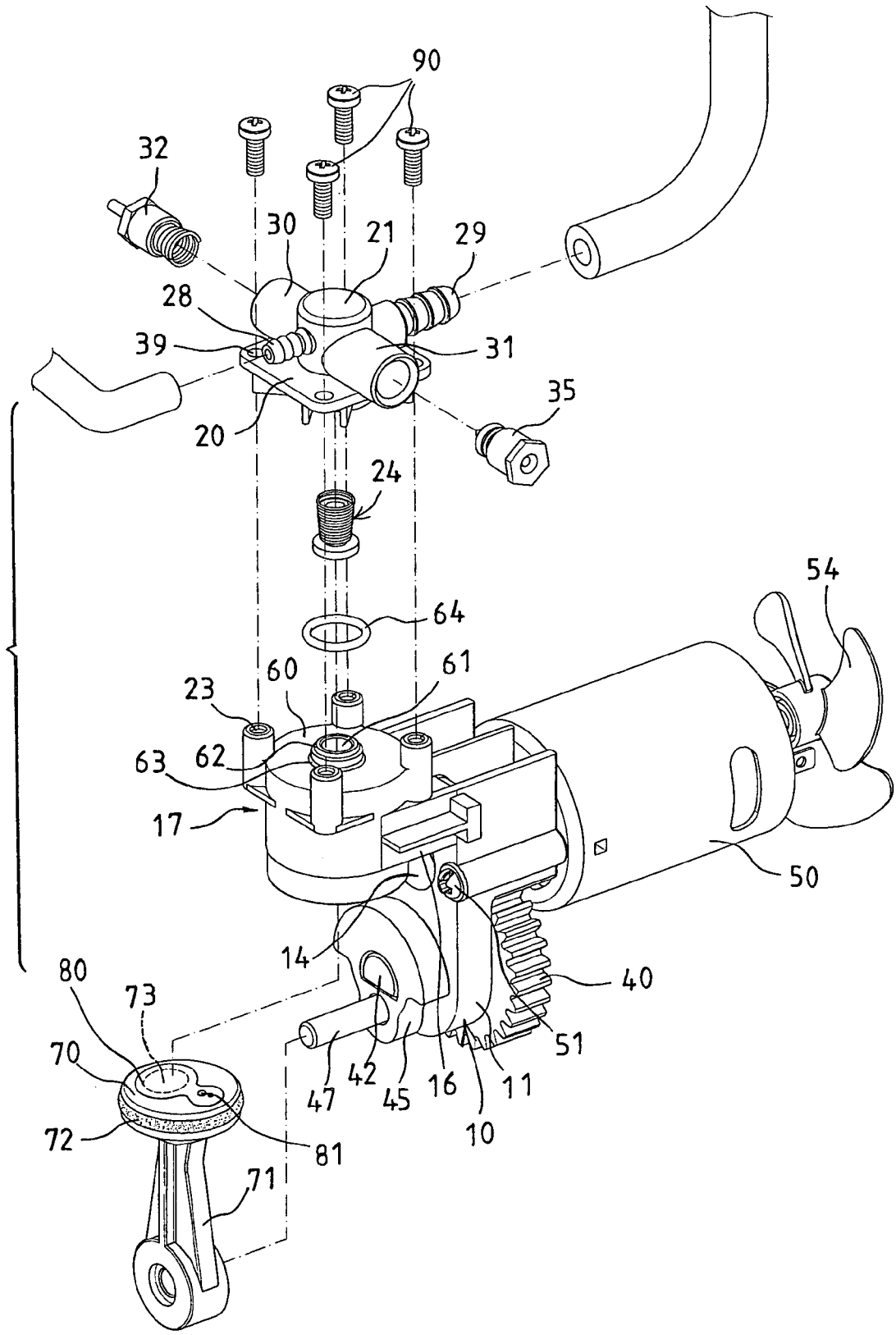
FIG. 17 is a partial exploded view illustrating the air compressor as shown in FIG. 16.

Further alternatively, as shown in FIGS. 16–17, the cover 20 of the cylinder housing 17 includes no inlet formed therein, and the upper wall 60 of the cylinder housing 17 also includes no inlet formed therein, but also spaced away from the cover 20. Instead, the piston 70 includes a bore 73 formed therein, and the valve device 80 includes one or first end 81 engaged with or attached to the piston 70, for biasing and blocking or enclosing the bore 73 of the piston 70, and for forming a check valve means or device to control the outside air to intake or to flow into the chamber 18 of the cylinder housing 17 when the piston 70 moves away from the cover 20, and to prevent the inner air from flowing backwardly or outwardly from the chamber 18 of the cylinder housing 17 through the bore 73 of the piston 70, or from flowing out of the chamber 18 of the cylinder housing 17 when the piston 70 moves toward the cover 20.

It is to be noted that the cylinder housing 17 as shown in FIGS. 9–17 may also be separated from the plate 11, and may also be detachably secured to the plate 11 with such as fasteners 99, similar to that shown in FIG. 8, to allow different cylinder housings 17 of different structures or contours to be detachably or changeably secured to the plate 11 with such as the fasteners 99 (FIG. 8).

Accordingly, the air compressor in accordance with the present invention includes a detachable or changeable structure for allowing an outlet tube of the air compressor to be adjusted to different angular positions or directions, and for allowing the air compressor to be attached to or received within various receptacles or packages.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An air compressor comprising:

a cylinder housing including a chamber formed therein, and defined by a peripheral wall, said cylinder housing including at least two studs provided on an outer peripheral portion thereof, a piston slidably received in said chamber of said cylinder housing, and having a piston rod extended therefrom, a motor coupled to said piston rod, for moving said piston relative to said cylinder housing in a reciprocating action, in order to generate pressurized air, and a cover detachably secured on top of said cylinder housing, and including at least two ears formed therein and selectively aligned with said at least two studs of said cylinder housing, for receiving fasteners which adjustably secure said cover on top of said cylinder housing, and including an outlet tube having a compartment formed therein and communicating with said chamber of said cylinder housing, for receiving the pressurized air from said chamber of said cylinder housing, and said outlet tube including at least one duct extended outwardly therefrom and communicating with said compartment of said outlet tube for receiving the pressurized air from said compartment of said outlet tube, said outlet tube including a valve seat provided therein, said cover including a check valve to control the inner air of said chamber of said cylinder housing to flow into said compartment of said outlet tube when said piston moves toward said cover, and to prevent the inner air from flowing out of said compartment of said outlet tube when said piston moves away from said cover, said check valve being disposed in said outlet tube and engaged with said valve seat, to control the pressurized air to flow from said chamber of said cylinder housing into said compartment of said outlet tube, and to prevent the pressurized air from flowing backwardly from said compartment of said outlet tube into said chamber of said cylinder housing, said cover including a valve device to control the outside air to flow into said chamber of said cylinder housing when said piston moves away from said cover, and to prevent the inner air from flowing out of said chamber of said cylinder housing through said valve device when said piston moves toward said cover, said cover including an inlet formed therein, said valve device being secured to said cover for blocking said inlet of said cover and for controlling the outside air to flow into said chamber of said cylinder housing, said cover including a recess formed therein and communicating with said inlet thereof, for receiving said valve device, said cover including a catch extended therefrom, said valve device including a first end secured to said catch of said cover, said cover including a peripheral slot formed therein, for receiving a sealing ring and for partially receiving said peripheral wall of said cylinder housing, and for making an air tight seal between said cover and said cylinder housing, a supporting base including a plate having an arm extended therefrom to support said cylinder housing, said motor being attached to said plate and including a spindle extended through said plate, and an eccentric member coupled to said spindle of said motor and having a pin extended therefrom and coupled to said piston rod, to move said piston relative to said cylinder housing in reciprocating action, said plate including a gear rotatably attached thereto and rotatably attached to said plate with a shaft, said eccentric member is secured to said shaft and has said pin extended therefrom, said cover including a first duct, and a second duct extended outwardly from said outlet tube and communicating with said compartment of said outlet tube, for receiving the pressurized air from said compartment of said outlet tube, a pressure gauge attached to said first duct, a nozzle coupled to said second duct, and a valve attached to said at least one duct, said cylinder housing including an open top, and said cover being detachably secured on top of said cylinder housing for enclosing and blocking said chamber of said cylinder housing, said cylinder housing including an upper wall provided thereon for enclosing an upper portion of said chamber thereof, said upper wall including a center opening formed therein and defined by a peripheral fence, and said cover being secured on top of said cylinder housing and including a check valve engaged into said compartment of said outlet tube and biased to engage with said peripheral fence, for controlling the inner air to flow from said chamber of said cylinder housing into said compartment of said outlet tube, said upper wall including an inlet formed therein, and a valve device secured to said upper wall, for blocking said inlet of said upper wall, and for controlling the outside air to flow into said chamber of said cylinder housing, and said piston including a bore formed therein, and a valve device secured to said piston, for blocking said bore of said piston, and for controlling the outside air to flow into said chamber of said cylinder housing.

* * * * *